United States Patent [19]

Wilson

[11] 4,050,542

[45] Sept. 27, 1977

[54] MOBILE RESCUE APPARATUS

[76] Inventor: Virgil D. Wilson, 8720 Selger Drive, Springfield, Va. 22153

[21] Appl. No.: 641,670

[22] Filed: Dec. 17, 1975

[51] Int. Cl.[2] ..... A62B 1/20; A62B 1/02

[52] U.S. Cl. ..... 182/10; 182/49; 182/191

[58] Field of Search ..... 182/10, 48, 49, 191, 182/11; 193/6, 17

[56] References Cited

U.S. PATENT DOCUMENTS

| | | | |
|---|---|---|---|
| 27,992 | 4/1860 | Lippman | 182/49 |
| 295,929 | 4/1884 | MacDonough | 182/10 |
| 336,414 | 2/1886 | Kerr | 182/10 |
| 636,605 | 11/1899 | Wilson | 182/10 |
| 2,576,389 | 11/1951 | Craighead | 182/63 |
| 3,088,542 | 5/1963 | Johnson | 182/48 |

*Primary Examiner*—Reinaldo P. Machado

*Attorney, Agent, or Firm*—Cushman, Darby & Cushman

[57] ABSTRACT

Mobile rescue apparatus is provided for rescuing individuals from modern high-rise buildings and the like. An elongated reeved telescoping chute is mounted on a mobile platform and is movable to any angle and extent to reach a desired portion of a building or the like from which rescue is to be effected. The chute contains apparatus mounted within for slowing and stopping (near the bottom of the chute) an individual sliding down the chute. The apparatus includes a pair of cable sections that flare out from the top of the chute to the bottom of the chute; an individual to be rescued is placed within a bag device which is clipped onto the cable sections, and then slid down the chute, the divergence of the cable sections slowing and stopping the individual near the bottom. Apparatus is provided for moving the cable sections with respect to each other to control the rate of descent, etc.

11 Claims, 6 Drawing Figures

14
15
16
10
18
19
20
21
23
24
25
27
31
36
38
40
42
44
51
53
54
55
68
69
70
71
72
73
74
75

MOBILE RESCUE APPARATUS

BACKGROUND AND SUMMARY OF THE INVENTION

With modern high-rise buildings, there is a great need for some form of rescue apparatus for evacuating individuals from upper floors of such buildings. Conventional rescue apparatus is inadequate for performing such evacuations when the area from which individuals are to be rescued is higher than just a few stories, and no conventional means are known for rescuing a large number of individuals from a given area in succession.

Prior art proposals for fire rescue have taken two general forms; apparatus located within a structure from which escape is desired and mobile units for evacuating individuals from buildings by bringing the apparatus to the building. Proposals for forms of the first type of apparatus are shown in U.S. Pat. Nos. 295,929, 536,088, and 1,116,189. All of these proposals are not practical if rescue is to be effected from more than one or two stories up, and if a large number of people must be rescued in a short period of time with minimum chance of injury to them. Proposals for mobile apparatus are illustrated in U.S. Pat. Nos. 775,158, 3,027,966, and 3,033,308. While such structures might allow for the evacuation of a number of people in succession, again such proposals are not practical when the individuals must be rescued from great heights, such as in modern high-rise buildings. Such proposals contemplate the use of chutes for effecting rescue, however, there are no means associated therewith that would slow the descent of an individual being rescued enough so that no injury would occur to him.

According to the present invention, for the first time apparatus is provided to rescue individuals — even injured and incapacitated individuals — from upper stories of modern high-rise buildings (i.e. as high as 27 stories up) with minimal chance of injuring the individuals, and with maximum efficiency, any number of individuals being rescuable in succession. According to the present invention, a mobile rescue assembly is provided that includes an elongated chute adapted to be brought into operative association with a building or the like, and means for controlling the descent of an individual in said chute so that the individual will be slowed down and stopped when he reaches the open bottom of the chute without injury, such descent controlling means including cable means mounted within the chute and flaring out from the top of the chute to the bottom of the chute.

An exemplary chute according to the present invention includes a number of reeved, telescoping sections, and means for controlling the inclination of the chute so that it is substantially horizontal (and retracted) during transport from one place to the other, and extends upwardly at an angle (and is extended) when moved into operative position. Means are provided for mounting the cable means within the chute so that the cable sections near the bottom of the chute can be moved from a first position wherein they are relatively widely spaced and maximum slowing of an individual sliding down the chute is provided, to a second position wherein they are relatively closely spaced, and an individual can slide down the chute relatively freely (and movable to any position in between said first and second positions). Individuals sliding down the chute are placed in bags or the like that are clipped to the cable sections, the flaring of the cable sections slowing the individual as he descends disposed within the bag.

It is the primary object of the present invention to provide an apparatus and method for effecting quick rescue of a number of individuals from high-rise buildings and the like with minimal chance of injury to the individuals. This and other objects of the invention will become clear from an inspection of the detailed description of the invention, and from the appended claims.

DETAILED DESCRIPTION OF THE INVENTION

Figure 4:
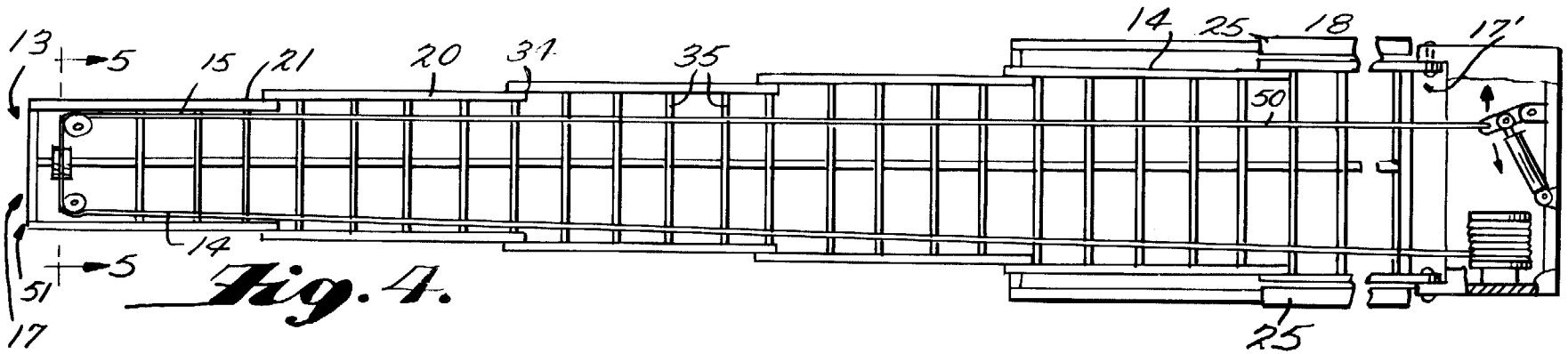
FIG. 4 is a top plan view of the chute of FIG. 3 when extended.

The invention relates to a mobile rescue assembly that includes an elongated chute 10, and a means 11 for (FIGS. 3 and 4) for controlling the descent of an individual in the chute so that the individual will be slowed down and stopped without injury when the open bottom of the chute is reached. The descent controlling means 11 includes cable means 13 mounted to the chute 10 in such a way that a pair of opposed cable lengths 14, 15 (FIG. 4) flare outwardly from the top of the chute to the bottom of the chute so that an individual sliding down the chute in a bag device (16 — FIG. 6) or the like operatively engaging the cable sections 14, 15 will be slowed down automatically as the bottom of the chute is reached. The chute has an open top 17 and open bottom 17'.

Figures 2, 5, 6:
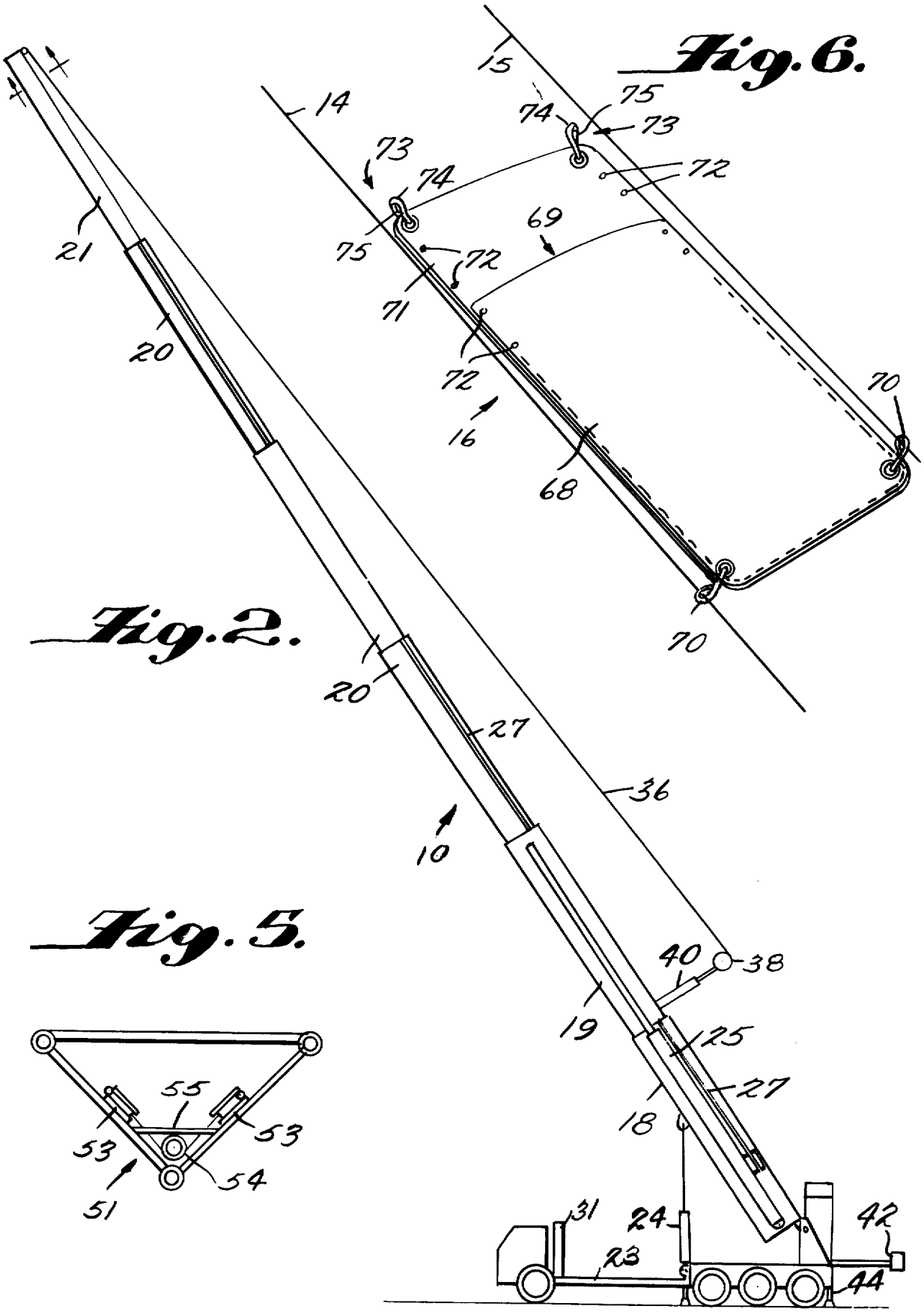
FIG. 2 is a side view of the apparatus of FIG. 1 shown in an operative position thereof.
FIG. 5 is a sectional view taken along lines 5—5 of FIG. 4, showing the cable mounting construction adjacent the open top end of the chute.
FIG. 6 is a perspective view of an exemplary bag device utilizable to effect rescues according to the teachings of the present invention.

The chute 10 preferably includes a plurality of telescoping sections including a bottom section 18, a section 19 adjacent to the bottom section, any number of intermediate sections 20, and a top section 21. The chute is mounted on a mobile platform 23 or the like, and any suitable means are provided for adjusting the angle of inclination of the chute 10, and for adjusting the length thereof, such as the hydraulic cylinder 24 mounted to the platform 23, and the hydraulic cylinder 25 and drum(s) 26 connected to reeved rope 27 or the like, for adjusting the angle of inclination and the length respectively of the chute 10. When the cylinder 25 is in its retracted position, the chute 10 is disposed in generally horizontal position on the platform 23 shown in FIG. 1 resting on a support 31 or the like if desired. When the cylinder 24 is extended, as shown in FIG. 2, the chute can have substantially any inclination, depending upon the amount the cylinder 24 is extended. The upper end portion 28 of chute bottom section 18 is pivoted at 29 by any suitable means to members 30 connected to platform 23 to allow movement of the chute 10 into a desired inclined position. The open top of each telescoping section 18, 19, 20, 21 has a ladder 35 formed therewith to allow a fireman to climb to the top of the chute.

Figure 3:
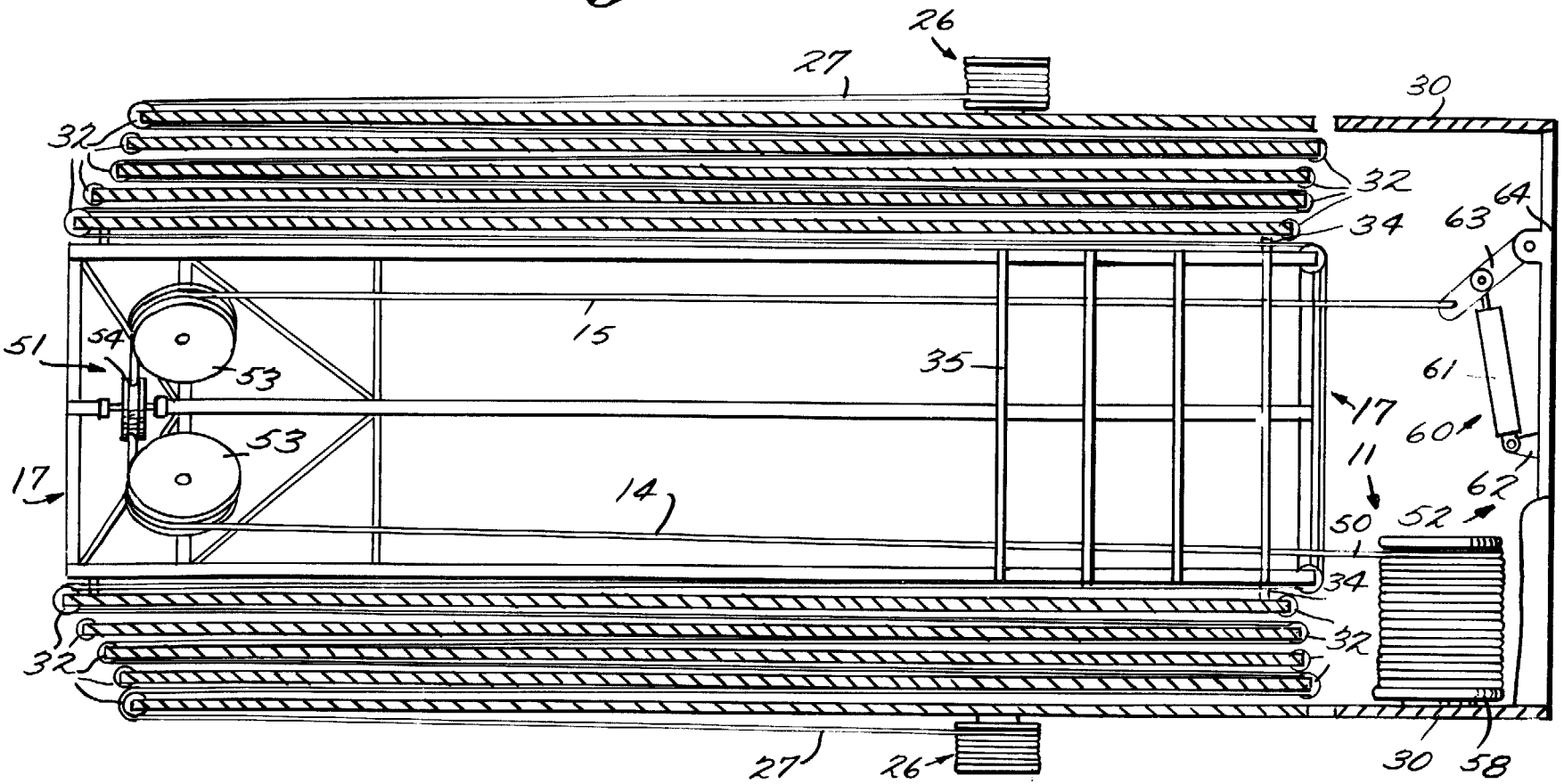
FIG. 3 is a sectional view taken along lines 3—3 of FIG. 1 showing in detail the reeving of the telescoping sections of an exemplary chute according to the present invention.

The reeving for the telescoping sections 18, 19, 20, 21 for the chute 10 is best shown in FIG. 3. The rope 27 extends from a drum 26 over the top of section 18, in between sections 18 and 19, around the bottom of section 19, upwardly to the top of section 19, in between section 19 and the next section 20, etc., until it reaches the bottom of the top section 21. If two drums 26 are provided, one mounted to each end of rope 27, then one continuous rope 27 need not necessarily be utilized, and the rope(s) 27 can be connected directly to the bottom of section 21, however, both when two drums 26 are utilized, and even when only one drum 26 is utilized, it is desirable to provide the rope 27 as one continuous member as shown in FIG. 3. It is noted that it is desirable to provide pulleys 32 mounted at each bend of the rope 27 in order to prevent fraying thereof, and to insure proper alignment of the rope 27 during operation. If one of the drums 26 is eliminated, the rope 27 end will merely be affixed to the outside of bottom section 18 at a suitable point. A power unit for rotating the drum(s) 26 to extend the chute 10 may be mounted within the drum(s) 26 if desired. Also, stops 34 associated with adjacent chute sections (shown only for section 21 and a section 20 adjacent thereto, but provided with all the sections) are provided in order to limit the extent of relative movement therebetween.

While the drum(s) 26 and rope 27 are utilized for extending the intermediate sections 20 and the top section 21, it is preferred that the hydraulic cylinder 25 be utilized for extending the section 19 with respect to bottom section 18. Since it is not possible to accurately determine the exact length of chute that is necessary to perform any given rescue operation, it is desirable to have some means of easily compensating for any errors in chute length as the chute top section 21 is brought into operative association with a building window or the like. Such compensation is provided by the cylinder 25. Before the sections 20, 21 are extended the cylinder 25 is actuated (with the drum(s) 26 in a neutral position so that the rope 27 may play out to any necessary extent) to move the section 19 about half-way out of the section 18. The rest of the sections are then extended until the estimated necessary length of the chute is reached, and then the chute top section 21 is moved into proper position. If it is then seen that the chute should be slightly longer, the cylinder 25 is extended the desired extra amount, and if it is then seen that the chute should be slightly shorter, the cylinder 25 is retracted the necessary amount, the chute being capable of extension approximately ½ the length of section 19, and being capable of retraction that same amount.

Also associated with the chute 10 may be a supporting cable(s) 36 or the like if desired. The cable 36 is attached at one end thereof to the top section 21, and at the other end thereof passes around drum 38 or the like. As the chute sections are extended, the cable 36 is allowed to play out on the drum 38 until the chute is in proper position. Then supporting rod 40 connected to drum 38 is moved from its flat position (FIG. 1) to an upright position (FIG. 2), and the cable 36 is then tightened on drum 38, providing a force holding section 21 and the rest of the chute up against gravitational forces tending to bend the chute top section 21 downwardly. Also, it is preferable that a counterweight 42 and supporting feet 44 (see FIG. 2) be provided to support the platform 23 in the position to which it is ultimately moved, and to counterbalance the force acting on the chute 10 when in operation in an extended position.

Preferred descent control means 11 according to the present invention are shown in detail in FIGS. 3–5. The cable sections 14 and 15 are preferably merely portions of the same continuous steel cable 50 or the like, means 51 being provided for mounting the cable to the top section 21 of chute 10 adjacent open chute top 17, and means 52 being provided associated with members 30 for mounting the cable 50 adjacent the bottom of chute 10. The means 51, shown in detail in FIG. 5, includes a pair of pulleys 53 mounted to side walls of the top chute section 21, and a pulley 54, having an axis at an angle with respect to the axes of the pulleys 53, and substantially parallel to the direction of elongation of the chute 10, mounted adjacent the bottom of the chute section 21. The cable 50 is wrapped around one pulley 53, over pulley 54, and over the other pulley 53. It is noted from FIG. 5 that the chute may have a more or less triangular cross-section, a bottom 55 being provided within the sections. While such a cross-section is desirable under many circumstances, of course other cross-sections are possible, including circular, square, etc. As can be seen in FIG. 5, it is preferred that the pulleys 53 be mounted near the top of each of the side walls of the chute section, and that the cable sections 14, 15 extend near the top of the chute 10 all the way down the length thereof. Care is taken to insure that the cable 50 does not interfere with any portions of rope 27.

Figure 1:
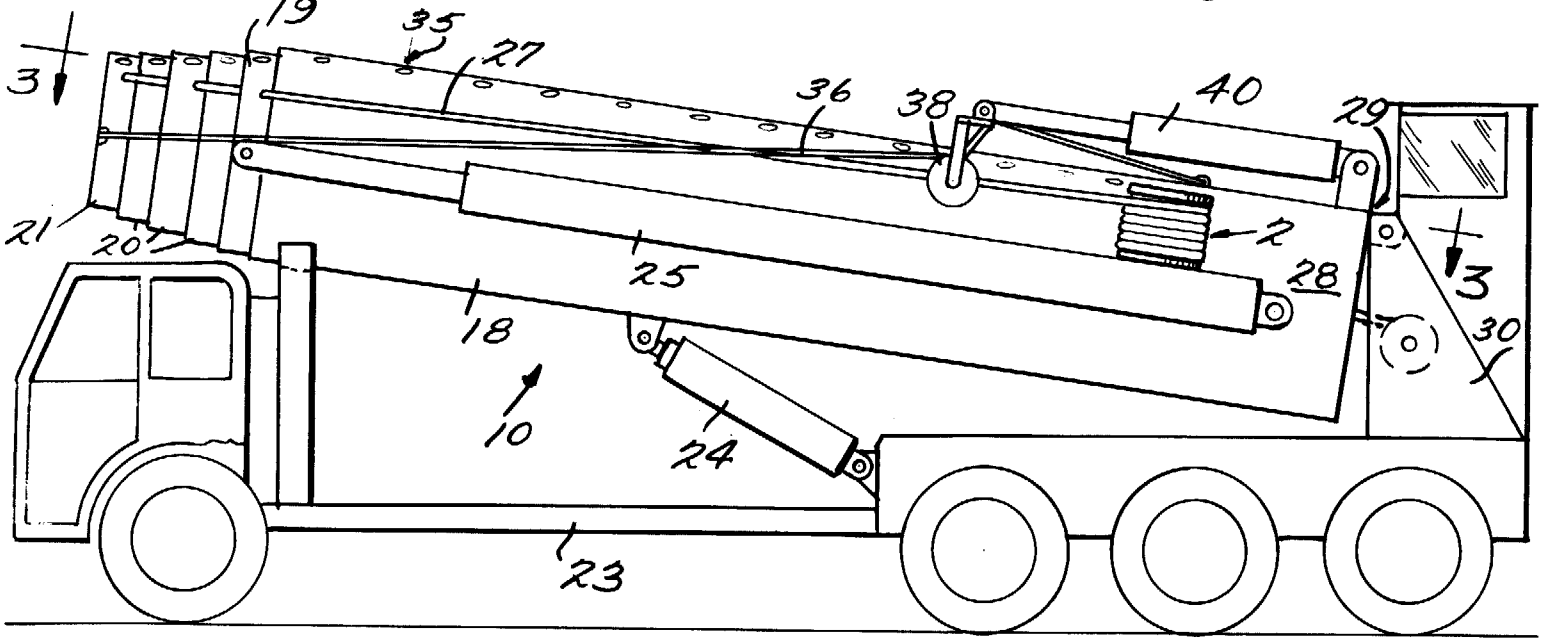
FIG. 1 is a side view of exemplary apparatus according to the present invention shown in transporting position thereof.

The means 52 for mounting the cable 50 adjacent the open bottom 17' of the chute 10 includes a drum 58 mounted between members 30 adjacent the top portion thereof (see dotted lines in FIG. 1). The drum 58 may be set to allow the cable 50 to play out when the chute sections are extended, may be set to rewind the cable 50, and also may adjust the tension in cable 50. The end of cable 50 not attached to the drum 58 may be affixed to a member 30 if desired, however it is preferred that a means 60 be employed to allow quick and easy release of the cable tension so that once an individual has been stopped in the chute 10 he can be readily removed from the open bottom 17' of the chute 10. Such a means 60 may consist of any means for moving the bottom of the cable sections 14, 15 with respect to each other from a first position (FIG. 4) wherein they are relatively widely spaced from each other, and maximum slowing action is provided by the descent control means 11, to a second position (FIG. 3) wherein they are relatively close to each other so that less slowing action is provided by the descent control means 11. Such means 60 may take the form of a hydraulic cylinder 61 or the like pivotally mounted to member 62 rigidly attached to one member 30, and pivotally mounted at the other end thereof to overcenter lever 63 which is pivotally mounted to member 64 attached to a member 30. As the cylinder 61 is extended, it moves the cable 50 end connected thereto (and lever 63) from the position shown in FIG. 3 on one side of lever 63 center, to the other side of lever 63 center, the cable section 15 being moved outwardly at the bottom thereof with respect to section 14. Obviously, the cylinder 61 may be stopped at any position intermediate the extremes shown in FIGS. 3 and 4, the selected position of the cylinder 61 being determined dependent upon the weight of the individual sliding down the chute, the angle of inclination of the chute, and the speed at which it is desired that the individual be allowed to slide down the chute. If an individual is stopped by the cable sections 14, 15 somewhere in the chute above the bottom thereof, the cylinder 61 is merely retracted slightly, and the individual will slide down the rest of the way in chute 10.

A form that the bag device 16, that is utilized with the chute 10 and cable means 13 arrangement according to the present invention, may take is shown in FIG. 6. A bag body member 68, formed of nylon, canvas, cloth, burlap or the like, has an opening 69 therein. A fireman on top of the upper portion of top section 21 of chute 10, or in a building from which people are being rescued, places an individual to be rescued into bag 68 through opening 69. Clips 70 at the lower end of the bag are opened, and snapped closed over the cable sections 14, 15, the top flap 71 of the bag body 68 is folded over the opening 69 (fasteners 72 may be provided for releasably holding the top flap 71 to the body 68), and clips 73 on flap 71 are opened and snapped closed over cable sections 14 and 15. While the clips 70, 73 may take any suitable form, they are shown in the drawing as having a hook portion 74 for engagement with a retractable spring-biased plunger 75.

It is noted that additional means may be associated with the chute 10 for fighting of a fire. For instance, a turret or the like, having a water gun associated therewith may be mounted on top of the top section 21 to facilitate fire fighting during rescue operations.

Apparatus according to the present invention having been described, the operation thereof will now be set forth. When a rescue operation is to be performed, such as from a burning building, the mobile platform 23 is backed into close proximity with the building, the chute 10 is lifted off of support 31 by cylinder 24 and moved into approximately the correct angle of inclination, the section 19 is extended halfway with respect to section 18 by cylinder 25, and the chute sections 20, 21 are extended by rope 27 being taken up by drum(s) 26 until the approximate desired height is reached (it is noted that since each succeeding section 20, 21 is slightly smaller than the previous one, it is also slightly lighter, and the top section will extend completely first before the next one extends, etc.). A fireman climbs up the ladder 35 mounted on top of the chute 10, carrying a number of bag devices 16 (or a number of bags could be located on a platform or the like on top of chute 10), and the cylinder 25 (and possibly cylinder 24) are adjusted to place the open top end of chute 10 in proper position to receive individuals to be rescued. During chute extension, the drum 58 allows cable 50 to play out, and when the proper position is reached, the cable tension is set by rotating drum 58 and locking it in position, and the cylinder 61 is actuated, moving cable section 15 outwardly with respect to section 14, to the position shown in FIG. 4.

With the chute 10 in proper position, the fireman places an individual to be rescued into a bag device 16, fastens one clip 70 on cable section 14 and one on cable section 15, closes up flap 71, fastens one clip 73 on cable section 14 and one on cable section 15, and releases the individual to slide down the chute 10. Depending upon the tension of the cable 50, the dimensions of the bag, and the weight of the individual, the individual will either be in contact with floor 55 of chute 10 during descent, or will be suspended a small distance thereabove. The individual will slide down the chute to a position whereat the convergence of the cable sections 14 and 15 will stop the movement of the bag device 16 any further. If this point is directly at the open bottom 17' of chute 10, a fireman at the bottom merely unclips the clips 70 and 73, and releases the individual from the bag device 16. As is more often the case, if the individual is stopped some position above the open bottom 17' of chute 10, when (or just before) he is stopped, the fireman at the bottom of the chute operates cylinder 61 to move cable sections 14 and 15 closer together, and the individual will slide down the rest of the way, and then be released as described above. The cylinder 61 will again be actuated to move the sections 14 and 15 into proper operating position to receive another individual, and the next individual will then be slid down the chute by the firemen at the top of the chute.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A mobile rescue assembly comprising an elongated chute adapted to be brought into operative association with a high-rise building or the like and adapted to receive an individual therein for removal from said building or the like, said chute having an open top and an open bottom, and means for controlling the descent of an individual in said chute so that the individual will be slowed down and stopped when he approaches the bottom of the chute without injury to him, said descent controlling means including cable means mounted to said chute and having a pair of opposed cable sections extending from the top of said chute to the bottom thereof, portions of said cable sections at the top of said chute being relatively closely spaced with respect to each other, means located at the bottom of said chute for mounting portions of said cable lengths thereat in a relatively widely spaced position so that said cable lengths flare outwardly from the top of said chute to the bottom of said chute, so that an individual sliding down said chute in a device operatively engaging said cable sections will be slowed down automatically as the bottom of said chute is approached, operator controlled means for moving the portions of said cable sections at the open bottom of said chute with respect to each other to control the amount said cable sections are flared with respect to each other and thereby the rate of descent of an individual sliding down said chute, and means for receiving an individual therein within said chute, said receiving means having readily detachable fastening means for connecting said receiving means to said cable means.

2. An assembly as recited in claim 1 wherein said chute comprises a plurality of telescoping sections, said sections being movable with respect to each other to any desired relative position to reach a desired portion of a building or the like from which rescue is to be effected.

3. An assembly as recited in claim 2 wherein said chute is mounted on a mobile platform and includes a bottom section pivotally mounted to said mobile platform, and further comprising means for pivoting said chute with respect to said mobile platform to provide a variety of angular inclinations of said chute when in operative position.

4. An assembly as recited in claim 3 wherein means are provided for extending the chute sections with respect to each other, said means including a drum engaging a rope reeved through said chute sections.

5. An assembly as recited in claim 4 further comprising separate means for extending the next to bottom section of said chute with respect to the bottom section of said chute, said means comprising a hydraulic cylinder or the like having relatively movable ends thereof connected to said bottom section and said next to bottom section.

6. An assembly as recited in claim 1 wherein said cable portion moving means comprises a hydraulic cylinder pivotally connected at one end thereof to a stationary member, and pivotally connected at the other end thereof to a lever mounted to a stationary member, and to one end of said cable, the other end of said cable being in operative association with a rotatable drum mounted on a stationary member.

7. An assembly as recited in claim 1 further comprising support means for applying an upward force component to the top of said chute to counteract gravitational forces tending to bend the chute top downwardly.

8. An assembly as recited in claim 1 wherein said receiving means comprises a bag device, said bag device having readily detachable cable-receiving fasteners disposed at spaced points thereof, an individual disposed within said bag device attached to said cable sections being slidable down said chute and slowed to a stop by the divergence of said cable sections adjacent said chute bottom.

9. An assembly as recited in claim 8 wherein said bag device comprises a nylon bag having a flap or the like covering an opening therein for receipt of an individual.

10. A method of rescuing individuals from high-rise buildings and the like with a mobile rescue apparatus including a telescoping chute and mechanically controlled diverging cable sections mounted within the chute for slowing an individual's descent in the chute, and an individual-receiving device releasably connectable to said cable means and for receiving an individual to be rescued therein for controlled sliding down said chute, said method comprising the steps of a. moving said mobile apparatus into proper position adjacent a high-rise building or the like from which rescue is to be effected, b. extending said telescoping chute to position it in proper position with respect to a portion of said building or the like from which rescue is to be effected, c. placing an individual within an individual-receiving device at the open top of said chute and releasably fastening said device to said mechanically controlled diverging cable sections so that said cable sections will slow said individual as he slides down said chute and stop said individual adjacent the open bottom of said chute, d. unfastening said individual-receiving device from said cable sections adjacent said chute open bottom, and removing said individual and said device from said open bottom, and e. sequentially repeating steps (c) and (d) with different individual-receiving devices containing different individuals.

11. A method as recited in claim 10 wherein said step of extending said telescoping chute into proper position with respect to a portion of said building or the like from which rescue is to be effected is accomplished by initially moving the next to bottom section of said chute with respect to the bottom section of said chute approximately half the possible length of travel of said sections with respect to each other, extending out the rest of the chute sections to reach the approximate height and extent necessary, positioning the open top of said chute as close to the desired portion of said building as possible, and adjusting said chute length by moving said next to bottom section with respect to said bottom section to compensate for any difference between actual chute length and desired chute length so that the open top of said chute is in exact operative position, adapted to receive individuals therein.

* * * * *